US006076500A

United States Patent [19]

Clement et al.

[11] Patent Number: 6,076,500

[45] Date of Patent: Jun. 20, 2000

[54] METHOD AND ARRANGEMENT FOR CONTROLLING THE TORQUE OF THE DRIVE UNIT OF A MOTOR VEHICLE

[75] Inventors: Albrecht Clement; Torsten Bauer, both of Vaihingen; Berthold Steinmann, Asperg, all of Germany

[73] Assignee: Robert Bosch GmbH, Stuttgart, Germany

[21] Appl. No.: 09/150,026

[22] Filed: Sep. 9, 1998

[30] Foreign Application Priority Data

Sep. 10, 1997 [DE] Germany ..... 197 39 565

[51] Int. Cl.[7] ..... F02D 41/02

[52] U.S. Cl. ..... 123/362; 123/339.16; 123/339.17; 123/339.18

[58] Field of Search ..... 123/329, 339.16, 123/339.17, 339.18, 339.24, 350, 362

[56] References Cited

U.S. PATENT DOCUMENTS

| | | | |
|---|---|---|---|
| 4,592,323 | 6/1986 | Vest | 123/362 |
| 5,484,351 | 1/1996 | Zhang et al. | 477/113 |
| 5,595,159 | 1/1997 | Huber et al. | 123/362 |
| 5,657,230 | 8/1997 | Hess et al. | 123/350 |
| 5,692,471 | 12/1997 | Zhang | 123/350 |
| 5,692,472 | 12/1997 | Bederna et al. | 123/350 |
| 5,694,899 | 12/1997 | Chvatal et al. | 123/350 |
| 5,890,470 | 4/1999 | Woon et al. | 123/350 |

*Primary Examiner*—Erick R. Solis
*Attorney, Agent, or Firm*—Walter Ottesen

[57] ABSTRACT

The invention is directed to a method and an arrangement for controlling the torque of a drive unit of a motor vehicle. The desired torque or the actual torque of the drive unit is set into a relationship with a pregiven maximum permissible torque and the actual torque is limited or is reduced when the desired torque or the actual torque exceeds the maximum permissible torque. In one operating state, wherein the torque of the drive unit is increased by an additional loading, the maximum permissible torque is increased.

16 Claims, 2 Drawing Sheets

METHOD AND ARRANGEMENT FOR CONTROLLING THE TORQUE OF THE DRIVE UNIT OF A MOTOR VEHICLE

BACKGROUND OF THE INVENTION

U.S. Pat. No. 5,692,472 discloses a method and an arrangement for controlling the torque of a motor vehicle wherein the torque of the drive unit is adjusted in dependence upon operating variables of the drive unit and/or of the motor vehicle. Such an operating variable is, for example, the driver command. In the embodiment described, the drive unit is an internal combustion engine having a torque which is adjusted in dependence upon a torque desired value by influencing the following: the air supply, the ignition angle and the fuel metering. This desired value of torque is formed essentially on the basis of the position of an operator-controlled element such as the accelerator pedal and, if required, additional operating variables such as the engine rpm. Furthermore, and at. least on the basis of the driver command, a maximum permissible torque is formed which should not be exceeded in all operating points. The actual value of the torque of the drive unit is computed on the basis of operating variables such as rpm and load and, if required, while considering the ignition angle and fuel adjustment. According to the known procedure, the maximum permissible torque and the actual torque are compared to each other. If the detected actual torque exceeds the maximum permissible torque, the drive unit is controlled in such a manner that the maximum permissible torque is no longer exceeded.

When structuring the maximum permissible torque values in dependence upon driver command, all possibly occurring additional torques are to be considered for each operating point. One example of these additional torques is, in the idle range for a released accelerator pedal, the highest idle drag torque for a very cold engine inclusive of all disturbance variables from electrical consumers (power steering, et cetera). The increase of the actual torque by torques of this kind must be permitted so that the permissible torque values can be relatively high. On the other hand, the reaction of the vehicle should remain controllable in order to detect an impermissible torque increase as early as possible and to counter the same. If the maximum permissible torque for a warm engine is determined, then the permissible torque is exceeded by the actual torque in overrun operation above the idle range for a very cold engine because, then, the drag torque is significantly higher. In this way, the braking action can increase suddenly, for example, during overrun operation in the first gear.

In the known procedure, a compromise must therefore be found between the availability of the motor vehicle with a very cold engine and the operational reliability of the vehicle and this compromise cannot be solved for all operating cases. The same applies also with respect to additional consumers such as climate control systems, power steering, et cetera which increase the torque of the drive unit and load the drive unit.

SUMMARY OF THE INVENTION

It is an object of the invention to provide measures with the aid of which the maximum permissible torque is optimally adapted.

The method of the invention is for controlling the torque of a drive unit of a motor vehicle wherein the actual torque of the drive unit is adjusted at least in accordance with a command of a driver of the motor vehicle. The method includes the steps of: determining the actual torque of the drive unit; determining a maximum permissible torque at least on the basis of the command of the driver; reducing and/or limiting the actual torque when the actual torque exceeds the maximum permissible torque; determining at least one operating state of the drive unit wherein the actual torque is increased by an additional load on the drive unit; and, increasing the maximum permissible torque during the at least one operating state of the drive unit.

The conflict, which exists between availability and operational reliability of the motor vehicle when dimensioning the value of the maximum permissible torque, is solved in that the permissible torque is increased in dependence upon at least one operating variable which indicates an operation of the drive unit with a torque increased compared to the normal operation. It is especially advantageous when the permissible torque is increased during operation with a cold drive unit and/or during operation of a consumer which constitutes a load. The increase is again reduced outside of this operating state.

It is especially advantageous that the availability of the vehicle when the engine is cold as well as the operational reliability for both cold and warm engines is ensured.

It is especially advantageous that the operating state with a cold engine is determined in dependence upon a time after engine start (restart time), the engine temperature and the intake air temperature at start. In this way, the operating range with an increased permissible torque can very precisely delimited.

It is especially advantageous that, in the case of a defect in a temperature sensor, the torque of the drive unit can be limited in a case of doubt in favor of a reliably controllable reaction because the increase of the permissible torque does not take place when only one of the signals satisfies the conditions for increasing the permissible torque. With the use of the intake air temperature and engine temperature, a plausibility comparison is carried out between the two variables. A redundant configuration of the temperature sensors is therefore not necessary.

BRIEF DESCRIPTION OF THE DRAWINGS

The invention will now be explained with reference to the drawings wherein.

DESCRIPTION OF THE PREFERRED EMBODIMENTS OF THE INVENTION

Figure 1:
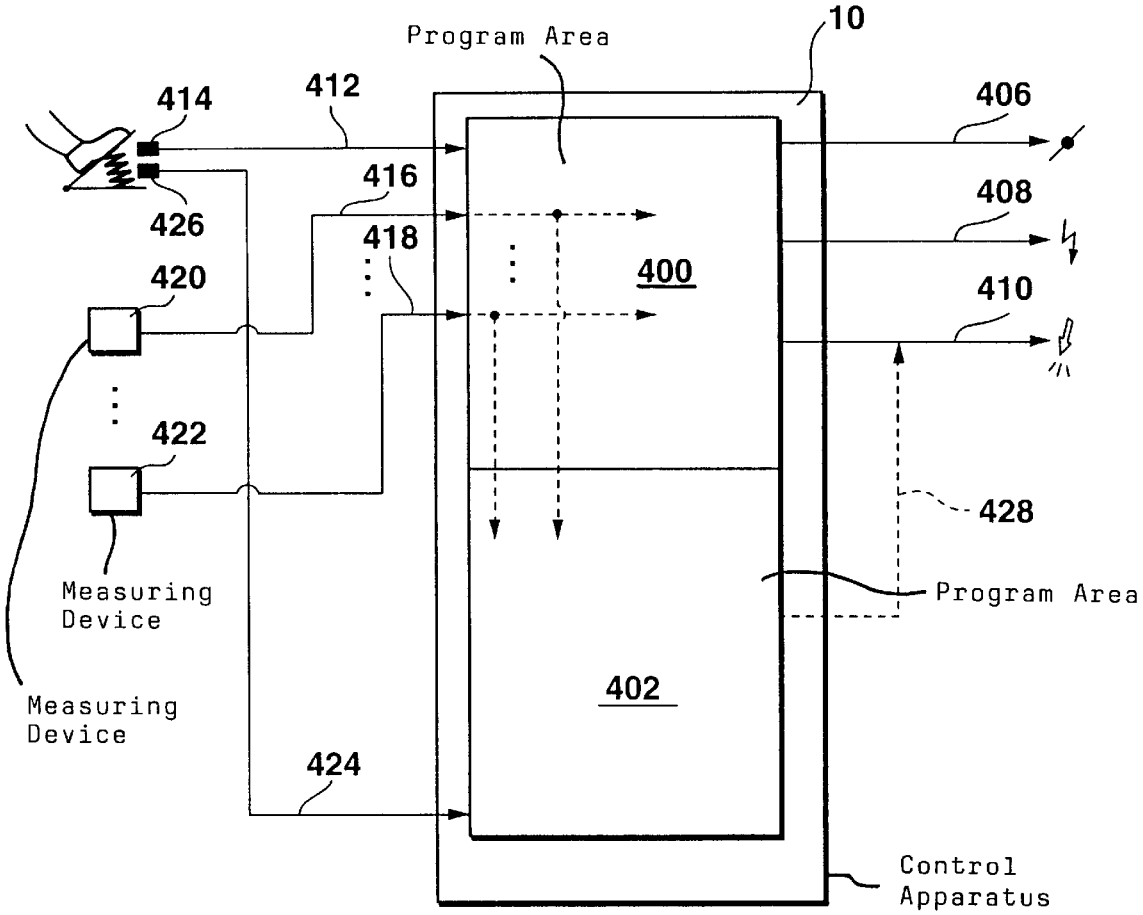
FIG. 1 is a block circuit diagram of a control system for an internal combustion engine in accordance with an embodiment of the invention; and, FIG. 2 is a flowchart showing the procedure for determining the permissible torque in accordance with an embodiment of the method of the invention.

FIG. 1 shows a preferred embodiment of a control system for an internal combustion engine. The control apparatus 10 includes a microcomputer which has essentially two different program areas 400 and 402 which are referred to hereinafter as level 1 and level 2.

In level 1, the functions provided for torque control are computed. From level 1, air supply, ignition and the fuel metering to the engine are controlled via respective output lines 406, 408 and 410. Additional signals are supplied to level 1 for computing functions for controlling the air supply, the ignition angle and the metering of fuel as known from the state of the art. These additional signals are supplied via input line 412 from a first measuring device 414 for detecting the accelerator pedal position and via input lines 416 to 418 from respective measuring devices 420 to 422 for detecting additional operating variables such as engine temperature, intake air temperature, switch-on of the ignition (engine start), engine rpm, exhaust composition et cetera.

Level 2 executes the monitoring measures. For this purpose, an input line 424 is connected to level 2 from a second sensor 426 for detecting the accelerator pedal position. In addition, selected signals are transmitted to level 2 as indicated by the broken lines in FIG. 1. These signals are supplied to level 1 via the input lines 416 to 418.

In the preferred embodiment, the actual torque and the maximum permissible torque are compared in level 2. In the case wherein the maximum permissible torque is exceeded, level 2 intervenes in the power control of the engine (see broken line 428). In a preferred embodiment, a comparison of the desired torque to the maximum permissible torque is made also in level 1. In the case where the maximum permissible torque is exceeded a limiting of the desired torque of the engine to the maximum permissible value takes place.

The computation of the desired and actual torques in accordance with the methods known from the state of the art is carried out, according to the particular embodiment, in levels 1 or 2 and the result of the one level is made available to the other level or, the computation of the desired and actual torques is carried out in both levels. The same procedure is used for the computation of the maximum permissible torque.

At least with respect to the computation of the maximum permissible torque, it must be ensured that the quantities, which form the basis of the computation, are free of error. A plausibility check of these quantities is therefore necessary. With respect to the driver command, this is achieved via a redundant detection (measuring devices 414, 426) and a separate read-in of the measured quantities. This plausibility check is executed automatically when using the intake air temperature and engine temperature because the increase of the permissible torque takes place only when both signal quantities drop below corresponding threshold values. If the permissible torque is increased in dependence upon the operating state of additional consumers, then the freedom from error of these status signals also has to be ensured, for example, via a redundant detection.

According to the invention, it is provided that the permissible torque in at least one operating state (wherein the permissible torque is higher compared to the other operating states, for example, for a cold engine) is increased. In this way, an acceptable compromise is ensured between the availability of high torques in this operating state (for example, for a cold engine with a high drag component) and a reliably controllable situation in the other operating states (for example, for a warm engine)

In a preferred embodiment, it is provided that, for a cold engine, the maximum permissible torques are increased and these maximum permissible torques are formed in level 1 and/or level 2. In a preferred embodiment, it is provided that this is done when a pregiven post-start time after "ignition-on" has not yet elapsed, the engine temperature at start is less than a pregiven threshold value and the intake air temperature at start is less than a threshold value. The threshold values are preferably the same. Increasing the permissible torque takes place in the preferred simple embodiment as an additional offset (fixed value) to the permissible torque value determined in dependence upon accelerator pedal position and rpm.

As an alternative to detecting a start from the signal "ignition-on" and to trigger the time function, an rpm threshold is pregiven (for example, 30 rpm). Exceeding this threshold characterizes the start operation and starts; the time function and the comparison of the temperature values to the threshold values.

Several temperature threshold values are provided in an advantageous embodiment in addition to the threshold value for the engine temperature and the threshold value for the air intake temperature. Different offset values for the permissible torque are formed when these threshold values are exceeded. Accordingly, an increasing reduction of the increase of the permissible torque value can be realized with increasing temperatures. In one embodiment, a characteristic field is provided which outputs a changeable offset value in dependence upon the temperatures.

In addition to one or several fixed values, in another embodiment, a characteristic line for correcting the permissible torque is provided preferably in dependence upon engine rpm when at least the one operating state is present. Correspondingly, in another embodiment, rpm-dependent characteristic fields and accelerator pedal-dependent characteristic fields are provided for the above-described operating state.

In addition to using engine temperature and air intake temperature during the start operation, in another embodiment, the increase of permissible torque values is pregiven in dependence upon the maximum value of temperatures during start or in dependence upon the maximum value of the existing actual engine temperature or actual intake air temperature (outside of start). In this embodiment too, in the case of doubt, the fault reaction is to the side of safety because only a smaller torque is permitted for high temperatures.

In addition to the use of engine temperature and intake air temperature during start, the actual temperatures are used in another advantageous embodiment. The increase of the permissible torque is then reduced when pregiven threshold values are exceeded.

A further embodiment is characterized in that the increase of the permissible torque is continuously reduced as a function of the engine temperature, which increases after start, and/or the elapsed time after start. Here, characteristic lines, characteristic fields or tables are provided wherein the maximum permissible torque or one or several corrective values for the maximum permissible torque are stored in dependence upon the post-start time, the engine temperature and/or the temperature of the inducted air. After start of the engine, the maximum permissible torque is continuously changed in dependence upon at least one of the above-mentioned operating variables. The corrective factor(s) are 0 for an operationally warm engine and/or after elapse of the post-start time. Stated otherwise, the increase of the permissible torque at start is continuously reduced with increasing engine temperature and/or with increasing post-start time.

In another advantageous embodiment, the consideration of one of the two temperatures is omitted.

Figure 2:
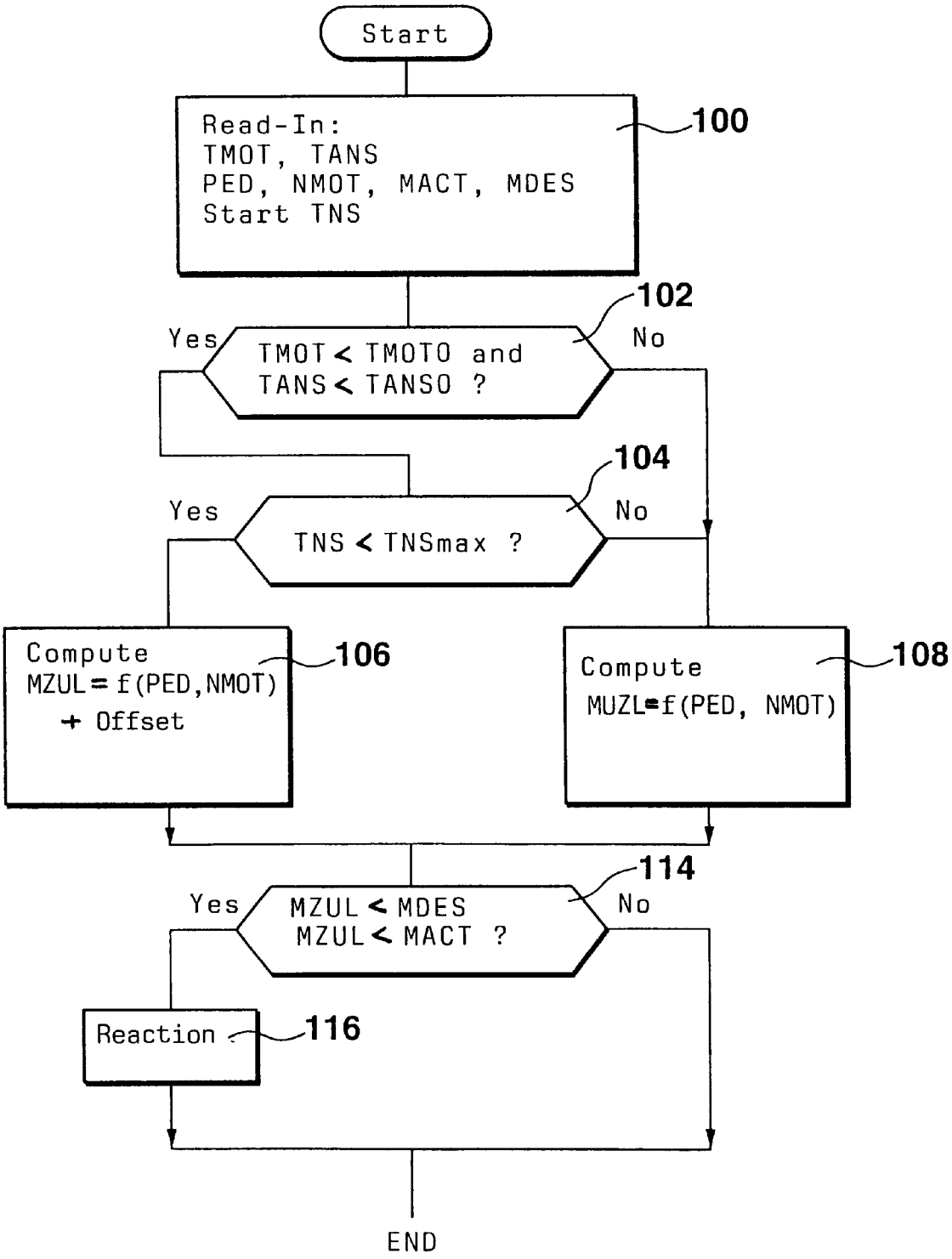

FIG. 2 shows a flowchart of a preferred embodiment of the method of the invention. The program described by the flowchart is run through at pregiven time points beginning with the start of the engine. The start is detected by the signal "ignition-on" or when exceeding an rpm threshold.

In the first step 100, the measurement variables for the following are read in: the engine temperature TMOT, the inducted air temperature TANS, the accelerator pedal position PED, the engine rpm NMOT and the computed actual torque MACT; and, also in the first step 100, the post-start counter TNS is started. Thereafter, in step 102, a check is made as to whether the inducted air temperature TANS and the engine temperature TMOT have dropped below predetermined threshold values TANS0 and TMOT0 which are preferably identical.

If this is the case, then, in step 104, the count of the post-start counter TNS is compared to the maximum value TNSmax. If the count of the counter is below the maximum value, then in step 106, the maximum permissible torque is computed from the accelerator pedal position PED and the engine rpm NMOT to which an offset value is added.

If the count of the counter does not drop below the maximum value (that is, if step 102 shows that both or one of the two measured temperatures exceeds the pregiven threshold value) then, in step 108, the maximum permissible torque is computed only from the accelerator pedal position PED and the engine rpm NMOT without the offset value.

Step 114 follows steps 106 or 108. In this step 114, the maximum permissible torque MZUL is compared to the measured actual torque MACT. If the actual torque does not drop below the permissible torque, then in accordance with step 116, a corresponding reaction is initiated which comprises at least a reduction of power or a limiting of power. If the actual torque is less than the permissible torque, then no reaction is initiated and the program is ended.

The flowchart of FIG. 2 shows a procedure in accordance with which the permissible torque is increased when the engine temperature and the temperature of the inducted air at the start of the engine drops below predetermined threshold values and the post-start time after start of the engine is not yet exceeded. In this case, the permissible torque is charged with an offset value (added) which is 0 outside of the operating state which is shown.

In addition to this one preferred embodiment, the above-described changes, supplements and expansions with respect to the correction of the maximum permissible torque and the determination of the operating state are built in with a corresponding modification of the program.

In an advantageous embodiment, the transition from a permissible torque, which is computed in accordance with step 106, to a torque computed according to step 108 and/or vice versa is smoothed by a filter (for example, a lowpass filter).

The invention is herein described with respect to an embodiment wherein the permissible torque is increased in a cold engine. In other embodiments, this is carried out in addition to or alternatively when at least one additional consumer, which loads the drive unit, is switched on, for example, a climate control, power steering et cetera; that is, always when at least an operating state is present wherein the torque of the drive unit is increased by an additional load.

It is understood that the foregoing description is that of the preferred embodiments of the invention and that various changes and modifications may be made thereto without departing from the spirit and scope of the invention as defined in the appended claims.

What is claimed is:

1. A method of controlling the torque of a drive unit of a motor vehicle wherein the actual torque of said drive unit is adjusted at least in accordance with a command of a driver of said motor vehicle, the method comprising the steps of:

determining said actual torque of said drive unit;

determining a maximum permissible torque at least on the basis of said command of the driver;

reducing and/or limiting said actual torque when said actual torque exceeds said maximum permissible torque;

determining at least one operating state of said drive unit wherein said maximum permissibe torque is higher due to an additional load on said drive unit compared to the other operating states; and, increasing said maximum permissible torque during said at least one operating state of said drive unit.

2. The method of claim 1, said drive unit being an internal combustion engine and said method further comprising the step of increasing said maximum permissible torque for a start of said engine when said engine is cold compared to a start of said engine when said engine is warm.

3. The method of claim 1, comprising the step of increasing said maximum permissible torque when a post-start time is less than a maximum time and said post-start time running with the start of said drive unit.

4. The method of claim 1, said drive unit being an internal combustion engine and said method comprising increasing said maximum permissible torque when the temperature of said engine at start thereof is less than a pregiven threshold value.

5. The method of claim 1, said drive unit being an internal combustion engine and said method comprising increasing said maximum permissible torque when the intake air temperature at the start of said engine is less than a pregiven threshold value.

6. The method of claim 1, wherein said drive unit is an internal combustion engine and said maximum permissible torque is increased when:

the temperature of said engine at the start thereof is less than a pregiven threshold value; or, the temperature of said intake air at the start of said engine is less than a pregiven threshold value; and, said threshold value for said engine temperature is equal to said threshold value for said temperature of said intake air.

7. The method of claim 1, wherein said drive unit is an internal combustion engine, the method further comprising beginning the post-start time when:

the switch-on of the ignition is detected; or, the rpm of said engine exceeds a pregiven rpm threshold.

8. The method of claim 1, wherein the increase of said maximum permissible torque is carried out as at least one of the following:

an additional offset value;

an offset characteristic line dependent upon operating variables;

a characteristic field dependent upon an operating variables; and, a characteristic line dependent upon at least one value of the temperature.

9. The method of claim 1, wherein said drive unit is an internal combustion engine; and, wherein the increase in maximum permissible torque is continuously pregiven by at leaet one of the following: the temperature of said engine and the time elapsed since the start of said engine.

10. The method of claim 9, wherein the increase of said maximum permissible torque is continuously reduced with increasing values of said engine temperature and/or increasing time after the start of said engine.

11. The method of claim 8, wherein said operating variables are the engine rpm and the accelerator pedal position.

12. The method of claim 8, wherein said characteristic line is dependent upon the maximum of the engine temperature or the maximum of the intake-air temperature or the actual value of both said engine temperature and said intake-air temperature.

13. The method of claim 1, wherein said drive unit is an internal combustion engine and said maximum permissible torque is dependent upon the rpm of said engine and upon the position of the accelerator pedal.

14. The method of claim 1, wherein at least one additional consumer is active which loads said drive unit; and, wherein said maximum permissible torque is increased for one operating state of said drive unit wherein said consumer is not active.

15. The method of claim 1, further comprising the steps of:

comparing said maximum permissible torque to at least one of the following: the actual torque and a desired torque determined at least on the basis of said command of said driver; and, reducing said maximum permissible torque to a limited extent when said desired torque and/or said actual torque exceeds said maximum permissible torque.

16. An arrangement for controlling the torque of a drive unit of a motor vehicle, the arrangement comprising:

a control apparatus for adjusting the actual torque of said drive unit at least in accordance with a command of the operator of said motor vehicle;

said control apparatus including:

first means for determining the actual torque of said drive unit;

second means for providing a maximum permissible torque of said drive unit;

third means for reducing or limiting the actual torque of said drive unit when said maximum permissible torque is exceeded;

fourth means for detecting at least one operating state of said drive unit wherein said maximum permissible torque of said drive unit is higher due to an additional load compared to the other operating states; and, fifth means for increasing said maximum permissible torque during said at least one operating state of the drive unit.

* * * * *